US005918698A

United States Patent [19]

Lunn

[11] Patent Number: 5,918,698

[45] Date of Patent: Jul. 6, 1999

[54] SAFETY SUPPORT APPARATUS FOR LADDERS

[76] Inventor: Timothy J. Lunn, 28811 Glen Ridge La., Mission Viejo, Calif. 92692

[21] Appl. No.: 08/863,907

[22] Filed: May 27, 1997

[51] Int. Cl.[6] ..... E06C 1/14

[52] U.S. Cl. ..... 182/107

[58] Field of Search ..... 182/107, 180.1–180.3, 182/200

[56] References Cited

U.S. PATENT DOCUMENTS

| | | | |
|---|---|---|---|
| 1,207,158 | 12/1916 | Gaffers | 182/180.1 |
| 4,311,207 | 1/1982 | Lurry | 182/206 |
| 5,165,501 | 11/1992 | Donahey | 182/214 |

FOREIGN PATENT DOCUMENTS

| | | | |
|---|---|---|---|
| 115514 | 12/1929 | Australia | 182/200 |
| 2275722 | 9/1994 | United Kingdom | 182/107 |

*Primary Examiner*—Daniel P. Stodola
*Assistant Examiner*—Hugh B. Thompson
*Attorney, Agent, or Firm*—William L. Chapin

[57] ABSTRACT

A safety support apparatus for ladders which enhances the stability of the lower end of the ladder against slipping, sliding or being jostled away from a position on the ground or other such supporting surface includes an open frame structure having a pair of laterally spaced apart A-frames. Each A-frame has a rearwardly and upwardly angled front leg and a rearwardly and downwardly angled, shorter rear leg. The front and rear legs are fastened together near their respective upper ends by an upper transversely disposed bolt, and at locations intermediate their ends by a longitudinally disposed straight side beam member. The two A-frames are held in a parallel vertical orientation by the combination of a front transversely disposed strut fastened at opposite lateral ends thereof to the upper surface of A-frame side members near their junction with the front A-frame legs, and a rear transversely disposed strut fastened at opposite lateral ends thereof to the rear A-frame legs, below the side members. A ladder inserted downwards into the open interior space of the frame structure, with the opposite side rails of the ladder parallel to opposite inner sides of the A-frame, is pivotably mounted to the apparatus by the inner protruding shanks of the upper A-frame bolts, each received through a bearing hole drilled through a ladder side rail, which is secured to the bolt by a fastener nut screwed down on the threaded shank of the bolt. Rearward pivotal motion of the upper portion of the ladder is limited by abutting contact of the ladder rails with a transversely disposed anti-kickback bar attached at opposite lateral ends thereof to the A-frame side members, below and rearward of the pivot axis. The apparatus stably supports a ladder at inclination angles between about 60 degrees and 85 degrees, in contrast to the 75-degree angle recommended for safe usage of a conventional ladder.

9 Claims, 11 Drawing Sheets

SAFETY SUPPORT APPARATUS FOR LADDERS

BACKGROUND OF THE INVENTION

A. Field of the Invention

The present invention relates to portable ladders of the type used in construction and maintenance. More particularly, the invention relates to a safety support apparatus for supporting and stabilizing the lower end of a ladder against both lateral and fore and aft motions.

B. Description of Background Art

Straight ladders consisting of either a single ladder or one or more such ladders slidably joined to one another to form an extension ladder, are widely used for maintenance and construction tasks, as well as by fire departments and emergency services. Ladders of this type typically have a pair of longitudinally elongated side rails, and a plurality of transversely disposed steps or rungs.

Straight ladders are most often used by placing the lower ends or feet of the rails on a relatively flat surface such as the ground or a floor, and leaning the upper end of the ladder against the side of a building wall, roof, tree, or other stable structure. The inclination angle of the ladder with respect to a horizontal floor or ground surface must be rather closely controlled to ensure stability of the ladder. Thus, if a ladder is inclined at too shallow an angle with respect to a horizontal surface, the rearward horizontal component of force exerted by the feet on the supporting surface in reaction to the weight of a person on the ladder may become large enough to cause the feet to slip rearward on the surface, away from the supporting wall. Conversely, if the ladder inclination angle is too large, i.e., close to 90 degrees, orienting the ladder nearly vertically, the ladder will tend to tilt backwards or even fall away from a building wall when climbed. For the foregoing reasons, ladder manufacturers typically recommend that the inclination angle be close to 75.5 degrees, corresponding to a one-foot spacing between a structure wall and the base of a ladder for each four feet of the ladder's slant length.

Some ladders are provided with "shoes" provided with a non-slip lower surface, the shoes being fixed or pivotably attached to the bottom ends of the ladder rails. Even when provided with such non-slip shoes, straight ladders are still practically restricted to a safe, stable inclination angle of about 75 degrees.

A number of U.S. patents disclose devices intended to stabilize ladders. These include:

Hurwitz, U.S. Pat. No. 3,937,298, Feb. 10, 1978, Leveling Attachment For Ladders, which discloses a leveling attachment for extension ladders which accommodates to uneven terrain and supports the ladder against leaning or tipping laterally. The attachment includes a pair of open end sockets attached at opposite ends of a transverse member which is attached to the rails of an extension ladder by a pair of laterally opposed U-bolts. Each U-bolt fits over transverse member and is bolted to a pair of longitudinally disposed channels that are attached to fore and aft sides of each longitudinal side rail of a ladder. Two short independently adjustable support legs are recessed in sockets, outboard of the ladder rails. A latching element associated with each socket locks each leg in a position of adjustment.

Blackstone, U.S. Pat. No. 4,069,893, Jan. 24, 1978, Ladder Stabilizer And Leveler, which discloses a ladder stabilizer and leveler support having laterally opposed, vertically disposed truncated A-frames, each A-frame having a pair of upper and lower parallel longitudinally disposed members for attachment to the rail of a ladder, and angled between front and rear members threadably supporting screw-jack like front legs, allowing independent adjustment of the length of each leg.

Kiimmerlin et al., U.S. Pat. No. 4,359,138, Nov. 16, 1982, Supporting Device For Ladders:, which discloses supporting devices for ladders having legs of individually adjustable length for supporting a ladder level on uneven surfaces, each of the supporting devices being attached to an adjacent pair of ladder rungs by a pair of laterally disposed, longitudinally opposed channel members which receive the ladder rungs, and which are held in a longitudinal spaced apart position clamping the rungs by a pair of laterally opposed, longitudinal spring or clamp member.

Ralston, U.S. Pat. No. 4,519,477, May 28, 1985, Ladder Stabilizing Apparatus, which discloses an adjustable ladder stabilizing apparatus that is attached to an extension ladder having hollow rungs. The device has two stabilizing elements made of aluminum which are located at different sides of the ladder. Each stabilizing element has an upper and a lower bracket which are connected together by two rigid pivotably-linked longitudinal members. The stabilizing elements are connected to each other by rods which extend through the hollow rungs of the ladder and which connect the upper and the lower brackets. The lower bracket and the lower longitudinal member are pivotably connected, and the upper bracket has a number of apertures spaced lengthwise of the ladder. By choosing the aperture to which the upper longitudinal member is connected, the attitude of each of the lower members is varied via the pivotable connection so as to lie on the surface adjacent the ladder side.

Murrell, U.S. Pat. No. 4,632,220, Dec. 30, 1986, Safety Ladder, which discloses a safety ladder having two outriggers fitted to its lower section, each outrigger extending outwardly and forwardly for the purpose of enhancing the safety of the ladder in use. Each outrigger has a foot and is capable of being folded up against and parallel to the stile to which it is fitted for storage or transportation. The outriggers are lockable in any desired position by a cam and friction plate mechanism. Preferably each stile is provided with an adjustable extension leg controlled by a ratchet and pawl arrangement to facilitate use of the ladder on uneven ground.

Kitson, U.S. Pat. No. 4,648,482, Mar. 10, 1987, Ladder Anchor, which discloses a ladder anchor comprising a hollow member having at least a wedge-shaped front portion provided with a closable orifice for filling the member with ballast such as water, or discharging ballast therefrom, the member having a ground engaging surface and a top surface, the top surface having therein at least one recess for receiving one or each of the longitudinal struts of a ladder and providing a foot receiving surface between the recess or recesses and the base of the member.

Cervantes, Sr., U.S. Pat. No. 4,679,652, Jul. 14, 1987, Automatically Adjustable Ladder Support, which discloses an automatically adjustable ladder support having four circular pedestals, each provided at the upper end thereof with a ball-and-socket type universal joint, the lower surface of the pedestals providing frictional engagement with the ground plane, thereby accommodating irregular ground surfaces. A pair of spring-loaded jaws extend parallel to one another for receiving the lower end of the ladder, and which, due to the weight of the ladder, are levered against a resistant spring force causing the jaws to close on the end of the ladder and secure it by clamping engagement. The jaws are mounted on end plates which are, in turn, pivotably mounted onto end wall assemblies that can rotate, thereby providing a self-adjustment of the lower end of the ladder between the jaws.

Harvey et al., U.S. Pat. No. 4,798,263, Jan. 17, 1989, Ladder Stabilizer, which discloses a stabilizer device for attachment to a ladder, comprising an attachment portion adapted to be attached to a stile of a ladder and a leg portion connected to and extending away from the attachment portion, the attachment portion being provided with two projections of adjustable length extending outwardly therefrom and positioned such that the stile can pass freely therebetween, and such that the projections engage the respective edge faces of the stile when the device is rotated about an axis generally parallel to the rungs of the ladder. The device can be in the form of a ladder anchor for preventing the bottom of the ladder from slipping, or in the form of a ladder stay for holding the top of the ladder away from a wall.

Wärnelöv, U.S. Pat. No. 4,896,745, Jan. 30, 1990, Adjustable Base For Ladders And Like Objects, which discloses an adjustable ladder base assembly for compensating an uneven foundation surface and/or to enable a ladder to be inclined at a given angle. The base assembly includes an arcuate bottom structure having footplate devices which can be brought into contact with the foundation surface, a strut which connects the two sides of the arcuate structure, and an attachment structure which is pivotally mounted to the strut and to the arcuate part and which is intended to support the ladder in a raised position. The attachment structure includes an upper, transverse bar which supports holding means for securing the sidepieces of the ladder. The bar is firmly connected by a spacer means, with a lower, transversely extending and upwardly open channel section which is intended to receive a rung of the ladder. The spacer means can be clamped to the arcuate part by the friction locking action of an upper, transversely extending U-shaped strut which embraces the arcuate part and is pivotally mounted to the strut via a lower arm.

Worthington, Jr., U.S. Pat. No. 5,044,468, Sep. 3, 1991, Ladder Leveling Device, which discloses a ladder leveling device having a pair of hydraulic cylinder/piston units to be secured at the outside lower ends of the ladder side rails in a manner so that the piston rods of the units extend as ladder supports. The working chambers of the units are in fluid communication with each other through a valved passageway which, when open, allow both piston rods to adapt to an irregular supporting surface while the ladder is oriented in a vertical plane. Upon closure of the passageway to isolate the working chambers of the respective units, the piston rods act as rigid extensions of the ladder side rails. Valving of the passageway is effected by an actuating member extending between the side rails in the region of a lower ladder rung so that the member may be depressed to close the passageway by one ascending the ladder by simply stepping on the actuating member.

None of the patents cited above discloses a ladder support apparatus which permits the ladder to be safely used at angles which deviate significantly from the recommended angle of about 75 degrees. The present invention was conceived of to provide a safety support apparatus for ladders which allows a ladder to be safely used over a relatively wide range of inclination angles, and which overcomes certain other limitations of prior art ladder support devices.

OBJECTS OF THE INVENTION

An object of the present invention is to provide an accessory apparatus for attachment to the lower portion of a straight or extension ladder which stabilizes the lower end of the ladder against inadvertent lateral or longitudinal slippage on a supporting floor or ground surface.

Another object of the invention is to provide safety support apparatus for ladders which comprises a frame that supports the lower end of a ladder, and stabilizes the ladder against inadvertent movement.

Another object of the invention is to provide a safety support apparatus for ladders which affords stable support for the lower end of the ladder at both substantially smaller and substantially larger angles than existing ladders.

Another object of the invention is to provide a safety support apparatus for ladders which pivotably supports the lower end of a ladder at a position spaced above the ground surface on which the frame rests.

Another object of the invention is to provide a safety support apparatus for ladders which includes four out-rigger legs which substantially enlarge the footprint and increase the stability of the ladder.

Another object of the invention is to provide a safety support apparatus for ladders which includes out-rigger legs and pivot means allowing pivotal motion in a vertical plane of a ladder with respect to the frame.

Another object of the invention is to provide a safety support apparatus for ladders which pivotably supports the lower end of the ladder, and includes stop means for limiting pivotal motion in a vertical plane of the ladder.

Another object of the invention is to provide a safety support apparatus for ladders which maintains a ladder at a desired inclination angle, with the rungs horizontal, even when the apparatus is supported by an irregular, non-level surface.

Another object of the invention is to provide a safety support apparatus for ladders which has legs that are individually adjustable in length, adapting the apparatus for use on non-level surfaces.

Various other objects and advantages of the present invention, and its most novel features, will become apparent to those skilled in the art by perusing the accompanying specifications, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention by limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an apparatus for safely supporting the lower end of a straight or extension ladder in a manner enhancing the stability of the ladder against slipping, sliding or being jostled out of position relative to the ground or other surface which supports the ladder.

The safety support apparatus for ladders according to the present invention comprises essentially an open frame structure which includes a pair of laterally spaced apart A-frames. Each A-frame is disposed in a vertical plane and is asymmetrical about a vertical altitude line, having a rearwardly and upwardly angled straight front leg and a rearwardly and downwardly angled, shorter rear straight leg. The front and rear legs are fastened together at their upper ends by a bolt, and at locations intermediate their upper and lower ends by a longitudinally and horizontally disposed straight side member. The two A-frames are held in a laterally spaced apart, parallel vertical orientation by straight front and rear horizontally disposed transverse strut members, which are fastened at opposite lateral ends thereof to the front upper surfaces of the front portions of the A-frame side members and the rear A-frame legs, respectively. Thus constructed, the lower ends of the four A-frame legs comprise the support feet for the frame structure, and define a rectangular footprint plane.

According to the present invention, the lower end of a ladder is pivotably attached within the frame by a pair of laterally inwardly projecting pivot bolts located slightly below the upper vertices of the A-frames, each pivot bolt also being used to secure together the upper ends of front and rear legs of each A-frame. The pivot bolts are attached to the side rails of a standard straight or extension ladder by a pair of laterally aligned bearing holes drilled through the side rails of the ladder, the holes being sufficiently close to the lower ends or feet of the ladder that the ladder ends are spaced above, and free to pivot with respect to, the ground or other surface on which the frame legs rest.

Preferably, the invention includes pairs of longitudinally elongated anchor plates, one each attached to the inner and outer sides of each of the two ladder rails, to reinforce the ladder rails in their area of attachment to the pivot bolts. Each anchor plate preferably has a pivot hole aligned with a hole bored through each side rail, for rotatably receiving the shank of a pivot bolt. In the preferred embodiment, each pair of pivot plates is attached to a ladder side rail by a pair of smaller bolts inserted through pairs of smaller bolt holes provided through the anchor plates and rails, on longitudinally opposed sides of the center pivot hole. Spacing between the outer wall of a side rail and the front angled leg of each A-frame is maintained by a bearing bushing of selectable length, which fits coaxially over the inwardly protruding shank of the pivot bolt. The inner end of each pivot bolt is secured by a wing nut tightened down on the inner wall surface of an inner anchor plate.

With a ladder pivotably attached to the novel safety support apparatus according to the present invention, the ladder may be angled forward at a substantially shallower angle than an unattached ladder, as low as 60 degrees, for example, while being safely and stabley supported by the support apparatus. Thus angled, the ladder may be safely and effectively used extended over furniture or other obstructions which would prevent access using a conventional straight ladder at the larger recommended angle of about 75 degrees.

The novel construction of the safety support apparatus for ladders according to the present invention also allows the ladder to be tilted rearward to a nearly vertical position at an angle as large as 85 degrees, allowing use of the ladder where minimum horizontal clearance is available. To provide this steep inclination capability, the apparatus is provided with a laterally disposed anti-kickback bar attached to the longitudinally disposed side members of the A-frames, below and rearward of the pivot axis. Abutting contact of the lower end of the ladder with the anti-kickback bar prevents the ladder from falling backwards in the direction of a person on the ladder. Moreover, the unique design of the safety support apparatus according to the present invention in which an anti-kickback member is incorporated, allows the ladder to be used in a free-standing mode, without requiring that the upper end of the ladder be supported by resting on a wall, roof, or any other structure, as long as backward weight distribution tending to tilt the ladder rearward is maintained.

Optionally, the frame legs of the safety support apparatus according to the invention are telescopically constructed to permit the length of each leg to be individually adjusted, adapting the apparatus to use on non-level supporting surfaces.

DETAILED DESCRIPTION OF THE PREFERRED EMBODIMENTS

Figure 1:
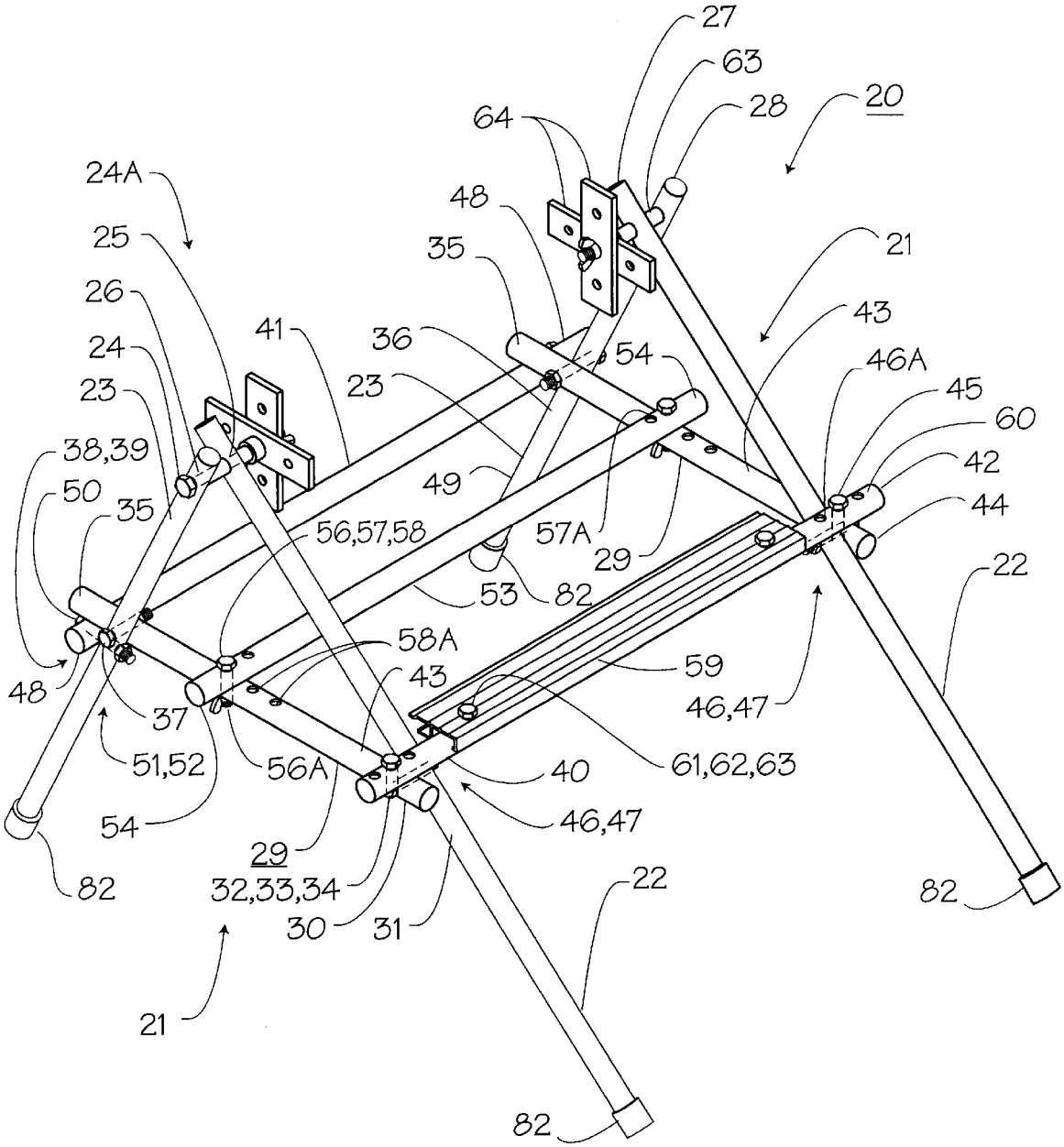
FIG. 1 is a left perspective view of a safety support apparatus for ladders according to the present invention.

FIGS. 1–14 illustrate various embodiments of a safety support apparatus for ladders according to the present invention.

Referring first to FIGS. 1–8, and particularly to FIGS. 1–5, a basic embodiment of a safety support apparatus 20 for ladders according to the present invention may be seen to include a pair of vertically disposed, laterally spaced apart A-frames 21 having a planar shape approximating the shape of the letter A. Thus, each A-frame 21 has a relatively long straight front leg 22 which angles upwardly and rearwardly, and a relatively shorter straight rear leg 23 which is joined to the front leg near its upper end, and angles downwardly and rearwardly therefrom. The upper end of front leg 22 is located laterally inwards from the upper end of rear leg 23, and the front and rear legs are fastened to one another by means of a transversely disposed bolt 24 having a shank 24A which is insertably received in holes 25 and 26 provided through the upper ends of front and rear legs, respectively, the holes being located longitudinally inwards a short distance from the upper transverse end walls 27 and 28, respectively, of the front and rear legs. Legs 22 and 23 may be made from strong, lightweight bar stock or, preferably, from aluminum tubing.

The planar geometrical shape of each A-frame 21 is rigidly maintained by means of a longitudinally and horizontally disposed straight side beam member 29. As shown in FIG. 1, side member 29 is attached at opposite longitudinal ends thereof to opposite lateral sides of front and rear angled legs 22 and 23, to enhance the torsional stability of A-frame 21. Thus, as shown in FIG. 1, the front longitudinal end portion 30 of side member 29 is fastened to the outer lateral side wall 31 of front leg 22, as for example by means of a transversely inwardly disposed bolt 32 passing through horizontally disposed holes 33 and 34 in side member 29 and front leg 22 respectively. Conversely, rear longitudinal end portion 35 of side member 29 is fastened to the inner lateral side wall 36 of rear leg 23, as for example, by means of a transversely disposed bolt 37 passing through holes 38 and 39 in side member 29 and rear leg 23, respectively.

The front and rear portions of A-frames 21 are secured in a laterally spaced apart, vertically disposed configuration by means of front and rear transversely disposed tubular members 40 and 41, respectively. Thus, as shown in FIGS. 1 and 2, each opposite outer lateral end 42 of front transversely disposed tubular member 40 is located above the upper wall surface 43 of side member 29, and is fastened to the front longitudinal end 44 thereof by means of a bolt 45 that passes vertically downwards through a vertically disposed hole 46 through the front tubular member, and through a vertically disposed hole 47 vertically disposed through the front longitudinal end of the side member, forward of horizontally disposed bolt hole 33.

Figure 2:
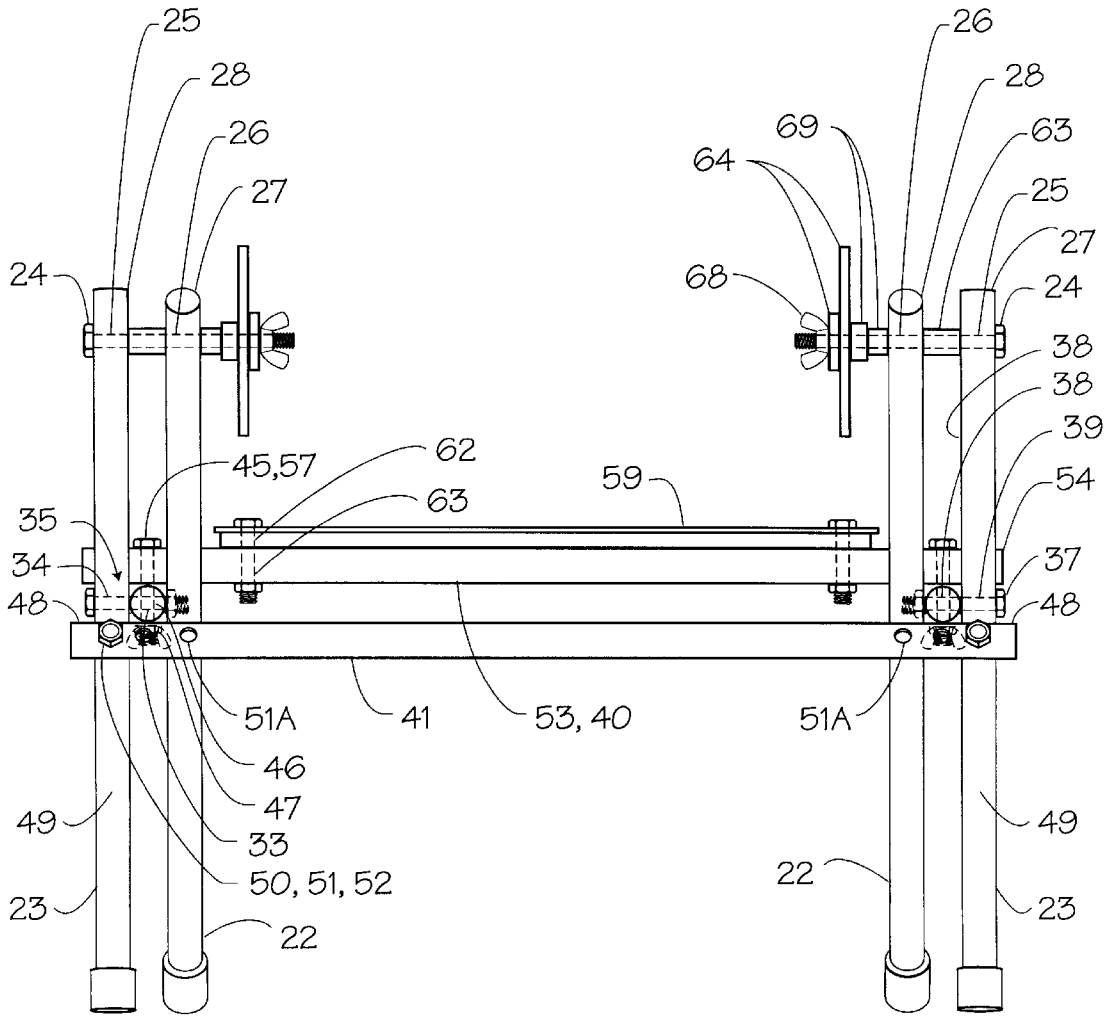
FIG. 2 is a rear perspective view of the apparatus of FIG. 1.

On the other hand, as shown in FIG. 2, rear transversely disposed tubular member 41 is located below rear longitudinal end portion 35 of each side member 29, and is attached at outer lateral ends thereof to rear angled A-frame legs 23. Thus, as shown in FIG. 2, each outer lateral end 48 of rear transverse tubular member 41 is secured to the rear surface 49 of rear A-frame leg 23 by means of an obliquely disposed bolt 50,passing through holes 51 and 52 provided through the rear transverse tubular member and the rear A-frame leg, respectively.

As shown in FIGS. 1 and 2, safety support apparatus 20 includes an anti-kickback member 53, the function of which will be described below. Anti-kickback member 53 comprises a straight, laterally and horizontally disposed tubular member which is attached at each outer lateral end 54 thereof to the upper surface 43 of each side member 29. As shown in FIG. 1, anti-kickback member 53 is located longitudinally approximately in vertical alignment with and below pivot bolts 24 of the upper sections of A-frames 21, and is attached to each side member 29 by means of a bolt 56 having a shank 56A which is insertably received through a vertically disposed hole 57 through outer lateral end 54 of the anti-kickback bar, and by a vertically disposed hole 58 through side member 29.

Referring now to FIGS. 1 and 2, it may be seen that safety support apparatus 20 is so constructed as to permit the lateral spacing between A-frames 21 to be adjusted to accommodate ladders of varying width. To provide this adjustability, one or more additional bolt holes are provided through the outer lateral ends of each laterally disposed member fastening A-frames 21 together, the additional bolt holes being laterally spaced apart from those described above. Thus, as shown in FIGS. 1 and 2, there are provided additional vertically disposed bolt holes 46A through the outer lateral ends of front tubular member 40, spaced laterally apart from holes 46, and additional holes 51A through the rear lateral ends of rear tubular member 41, spaced laterally apart from holes 51. Also, additional vertically disposed holes 57A are provided through the outer lateral ends of anti-kickback bar 53, spaced laterally apart from holes 57. With this arrangement, three fastening bolts on each side of safety support apparatus 20 may be inserted into selected longitudinally aligned hole triplets 56A, 57A and 51A, to adjust the width of the frame.

The preferred embodiment of safety ladder support apparatus 20 is also constructed in a manner permitting anti-kickback bar 53 to accommodate ladder rails of different fore and aft depths. Thus, as shown in FIG. 1, one or more additional vertically disposed bolt holes 58A are provided through each side member 29 spaced longitudinally apart from holes 58, permitting the longitudinal position of anti-kickback bar 53 to be adjusted.

Figure 5:
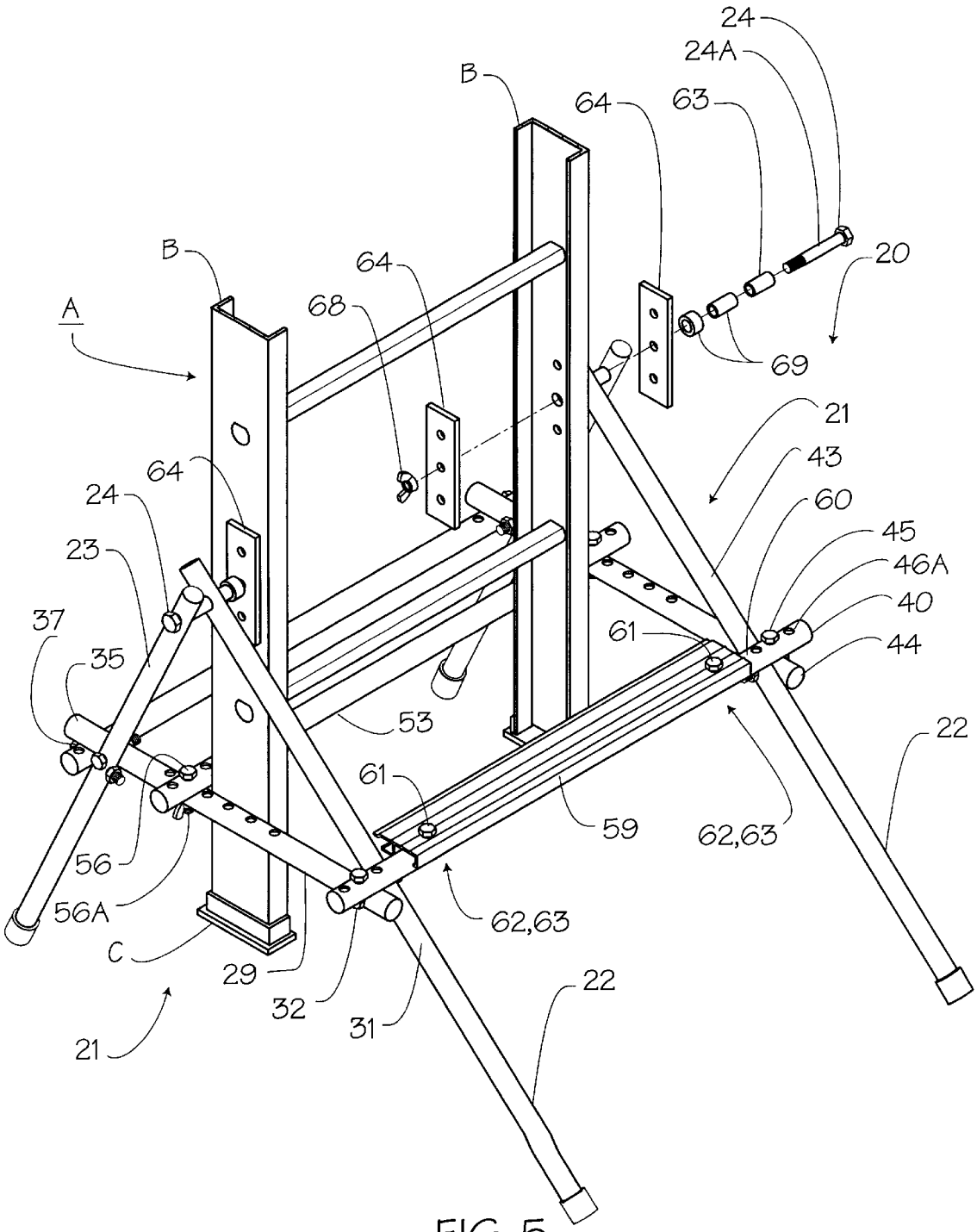
FIG. 5 is an upper right-side view of the apparatus of FIG. 1, showing the ladder of FIG. 4 attached to the apparatus.

As may be seen best by referring to FIG. 5, ladder safety support apparatus 20 preferably includes a laterally disposed, straight flat front step plate 59 attached to the upper wall surface 60 of front tubular member 40, by means of bolts 61 insertably received in vertically disposed holes 62 provided toward the outer lateral ends of the step plate, and holes 63 vertically disposed through the front tubular member.

Figure 3:
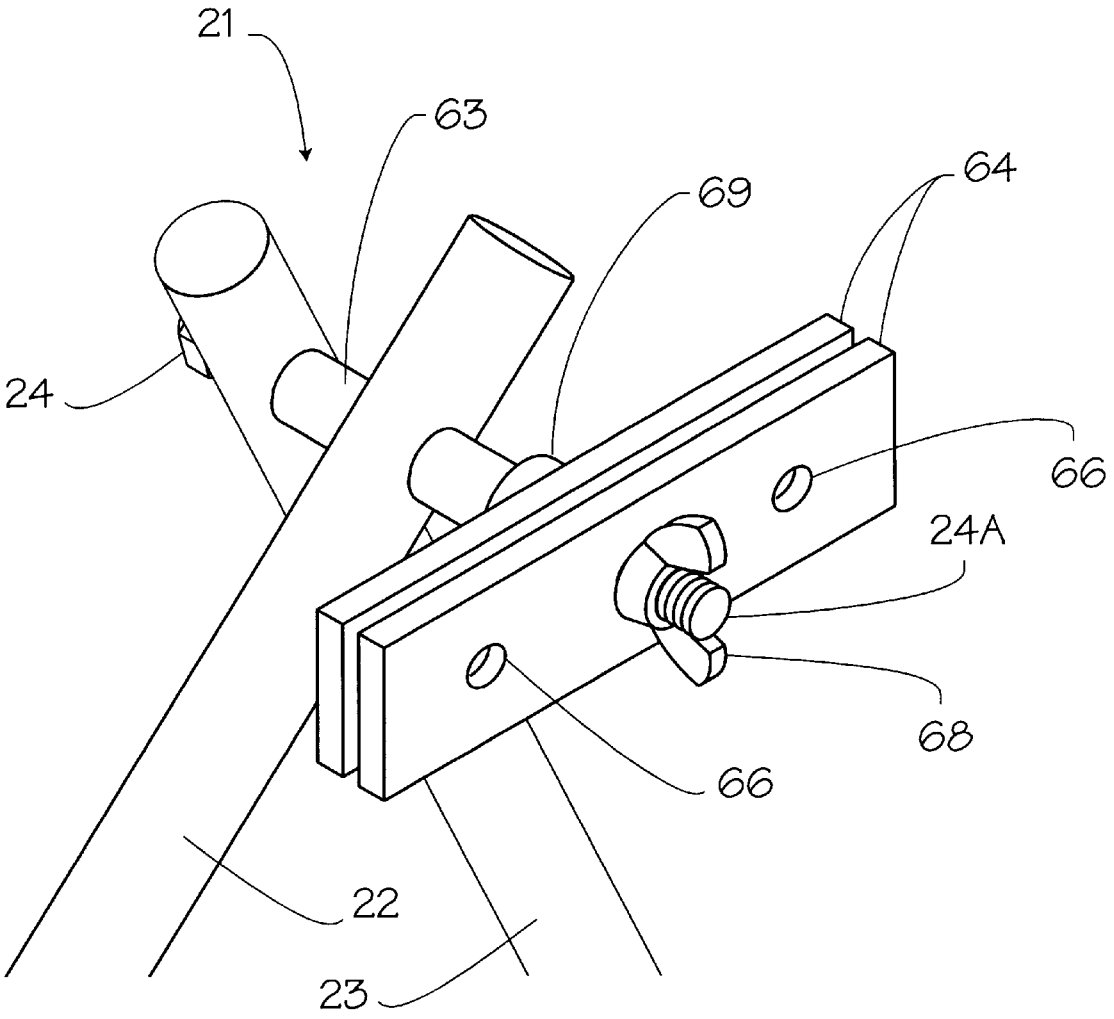
FIG. 3 is a fragmentary oblique front upper perspective view of the left-hand side of the apparatus of FIG. 1, on an enlarged scale.

The manner in which a ladder may be attached to safety support apparatus 20 to securely support the ladder, and further structural details of the apparatus which adapt it for that purpose, may be best understood by referring to FIGS. 4 through 7, in addition to FIGS. 1 through 3.

Referring now to FIG. 3, it may be seen that the upper end of front straight leg 22 of each A-frame 21 is located laterally inwards of the upper end of rear straight leg 23, owing to the fact that the front and rear legs are fastened to the inner lateral and outer lateral sides, respectively, of longitudinally disposed side member 29. Thus, to maintain the laterally spaced apart upper ends of the front and rear leg members in a rigid, parallel configuration, an outer, frame-spacer, bushing 63 having a length approximately equal to the width of side member 29 is fitted coaxially over that portion of shank 24A of pivot bolt 24 spanning the lateral distance between the upper ends of the two legs.

Figure 4:
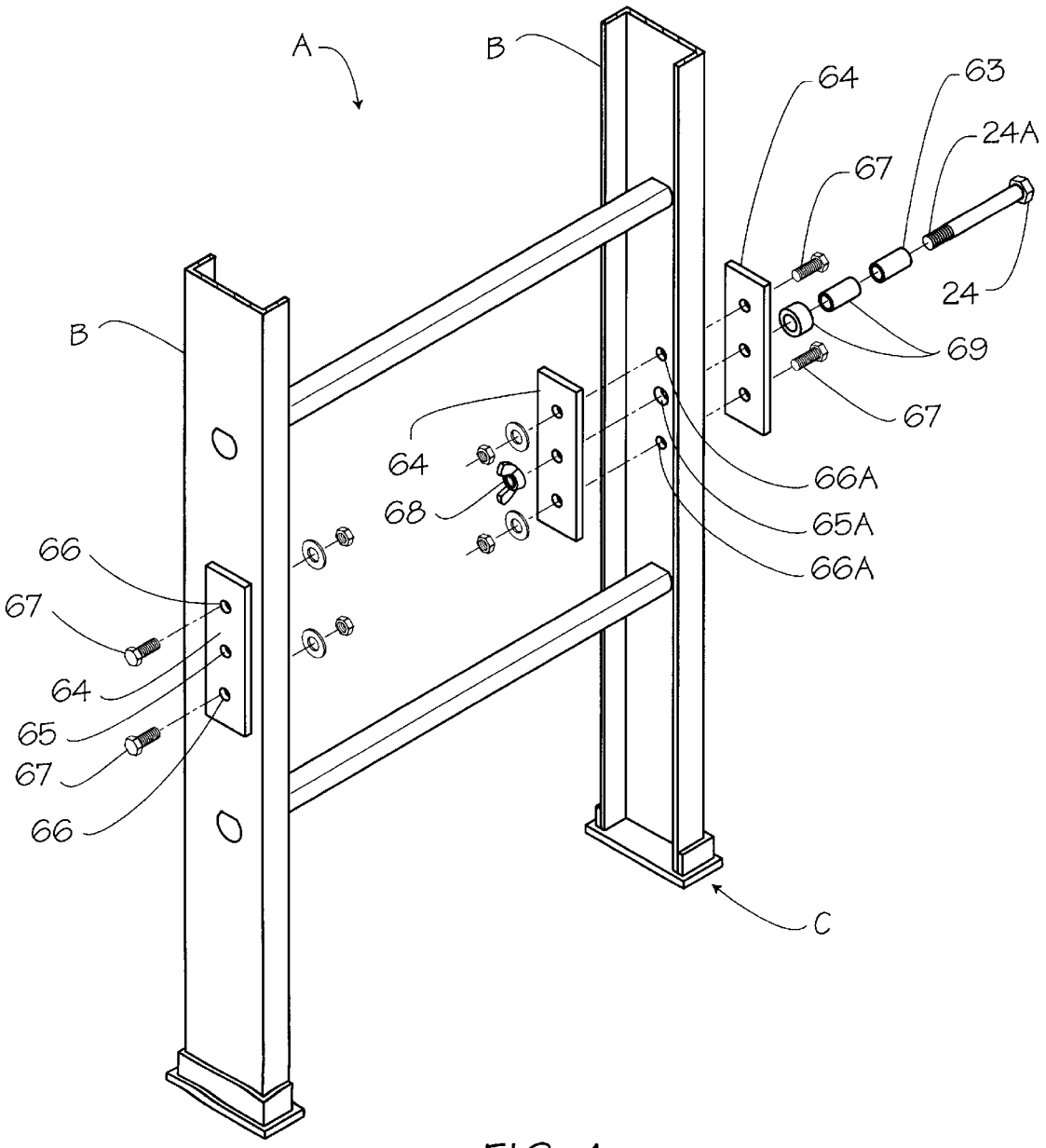
FIG. 4 is an exploded right side elevation view showing anchor plates, according to the present invention, ready for attachment a ladder rail.

As may be seen best by referring to FIG. 4, safety support apparatus 20 according to the present invention preferably includes two pairs of anchor plates 64, to facilitate secure, releasable attachment of the apparatus to the two opposite side rails B of a ladder A. As shown in FIG. 4, each anchor plate 64 is relatively thicker than the rail material of ladder A, and has a longitudinally elongated, rectangular plan view shape. A pivot hole 65 concentric with the perimeter of anchor plate 64 is provided through the thickness dimension of the anchor plate. A pair of smaller diameter fastening bolt holes 66 located on a longitudinal center line of anchor plate 64, equidistant from central pivot hole 65, are also provided through the thickness dimension of the anchor plate. Holes 65A and 66A are formed in each side rail B of ladder A, in alignment with holes 65 and 66 in anchor plate 64, at a selected height above the feet C of the ladder. Formation of holes 65A and 66A may be facilitated by using an anchor plate 64 as a drilling template.

A separate pair of anchor plates 64 is attached to each ladder side rail B, one plate of the pair on the inner side of the rail and one on the outer side of the rail, by fastening bolts 67 inserted through anchor plate holes 66 and ladder rail holes 66A. Then, as shown in FIG. 5, ladder A with attached anchor plates 64 may be fastened to safety support apparatus 20, as follows.

Referring now to FIGS. 4–7, it may be seen that ladder A is attached to safety support apparatus 20 by sliding shanks 24A of pivot bolts 24 laterally inwards through anchor plate pivot holes 65, and tightening a wing nut 68 down on the protruding threaded bolt shank, against the inner wall surface of an inner anchor plate 64. The outer sides of ladder rails B are maintained at a selected laterally inward spacing from the inner side walls of front A-frame legs 21 by means of one or more inner, ladder-spacing bushings 69 of selected length slipped over the shank 24A of each pivot bolt.

Figure 6:
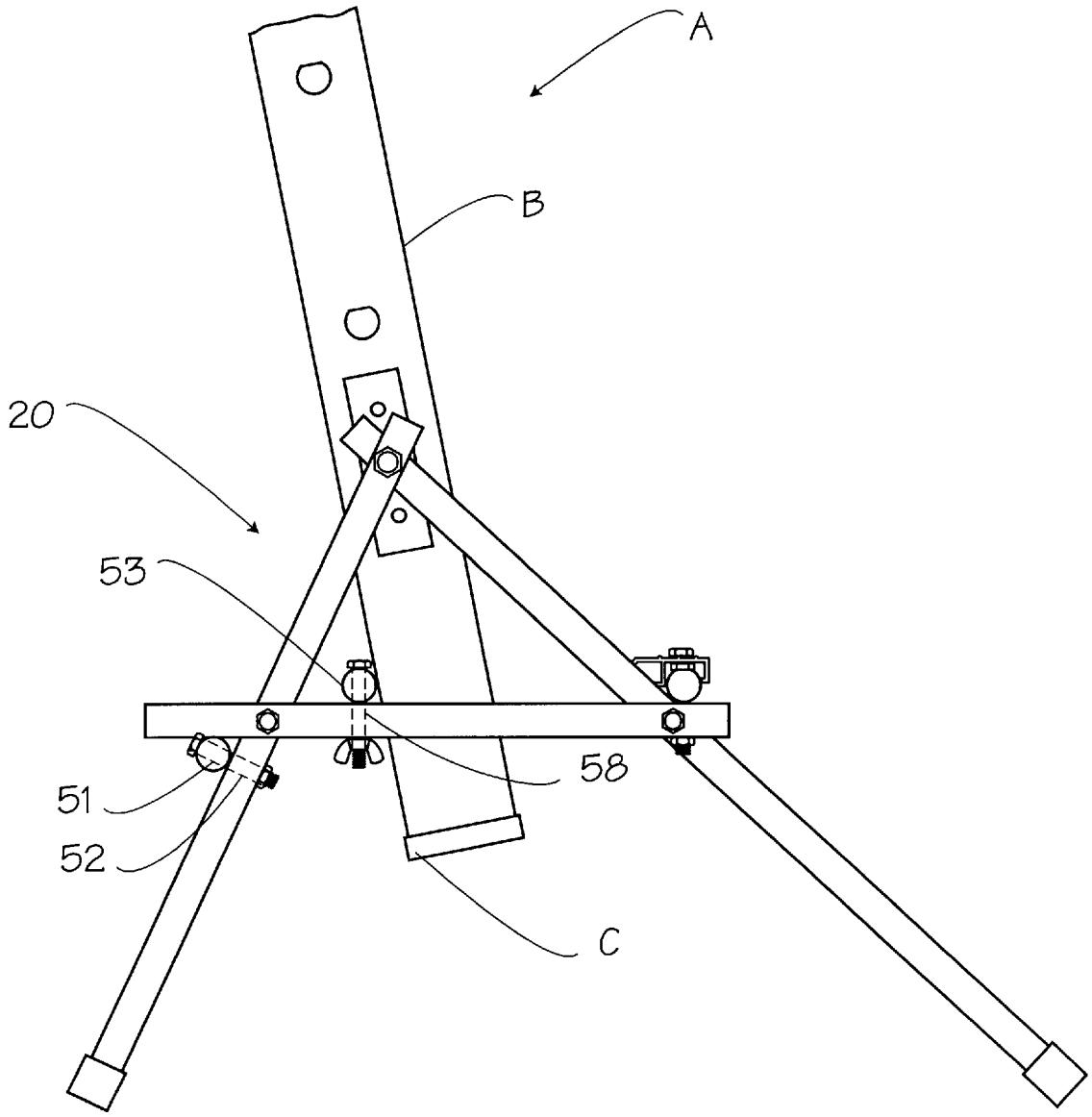
FIG. 6 is a right-side elevation view of the structure of FIG. 5.
Figure 7:
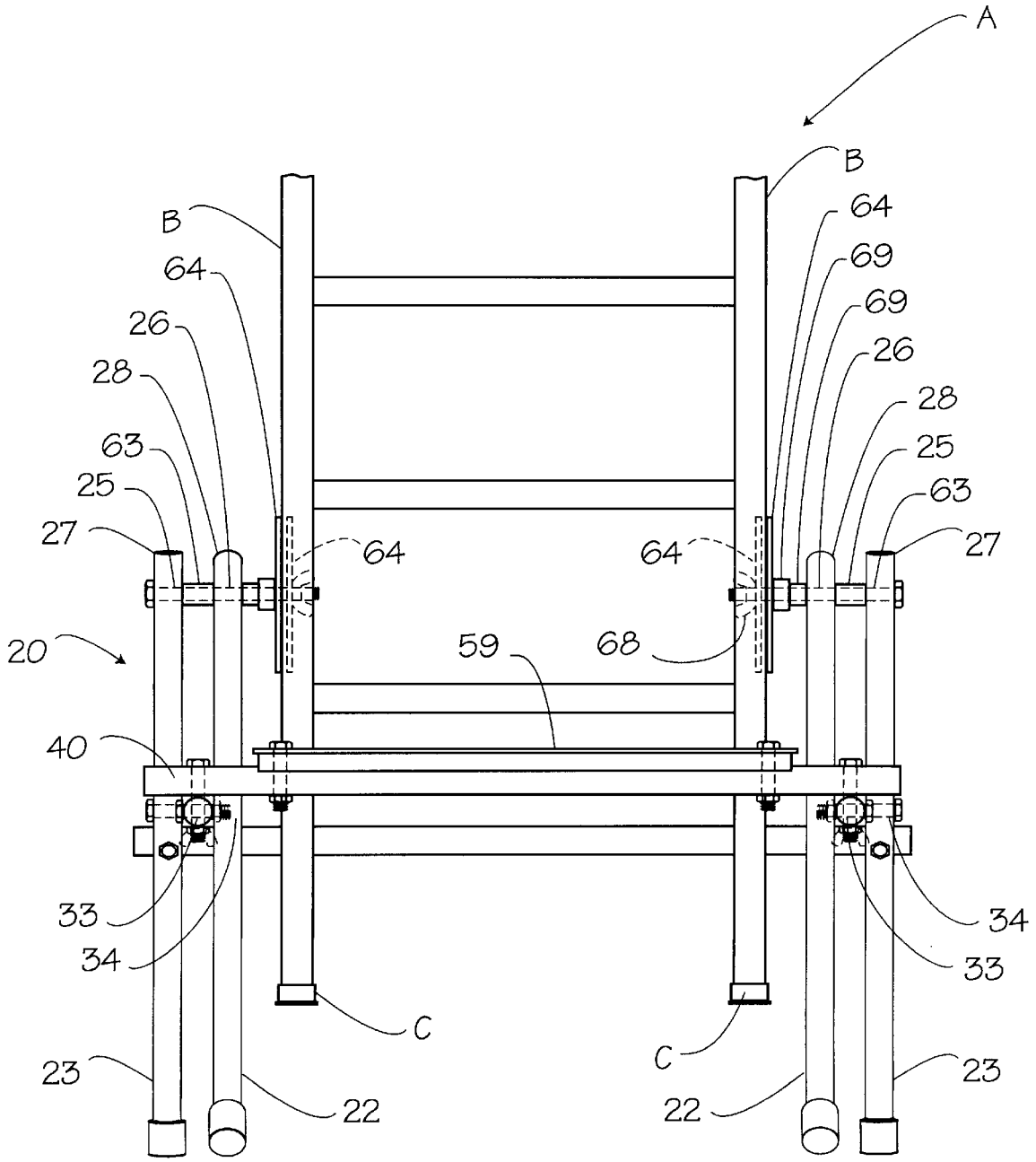
FIG. 7 is a front elevation view of the structure of FIG. 5.

With ladder A attached to safety support apparatus 20 as described above, the ladder is free to pivot in a vertical plane, with the feet C of the ladder spaced above the ground, as shown in FIGS. 6 and 7. Thus supported, the ladder may be used in a conventional way, by leaning the upper end D of the ladder against a wall, roof overhang, or other stable elevated structure, as shown in phantom in FIG. 8. However, owing to the novel design of the ladder support apparatus 20 according to the present invention, the ladder may be inclined at a much shallower angle to a horizontal surface S on which the frame rests. Thus, as shown in phantom in FIG. 8, the ladder A may be pivoted forward on pivot bolts 24 of safety support apparatus 20 until the upper ends of ladder rails B abut the lower surfaces of front transversely disposed tubular member 40. The present inventor has found that the inclination angle of a ladder pivotably supported by safety support apparatus 20 may be as shallow as 60 degrees, or even 55 degrees, in contrast to a minimum safe value of about 75 degrees for prior art ladders. This shallow inclination angle allows the base C of the ladder to be spaced a substantially greater distance from a structure wall than prior art devices, thus allowing a ladder to be used over furniture or other obstructions adjacent a structure wall.

Figure 8:
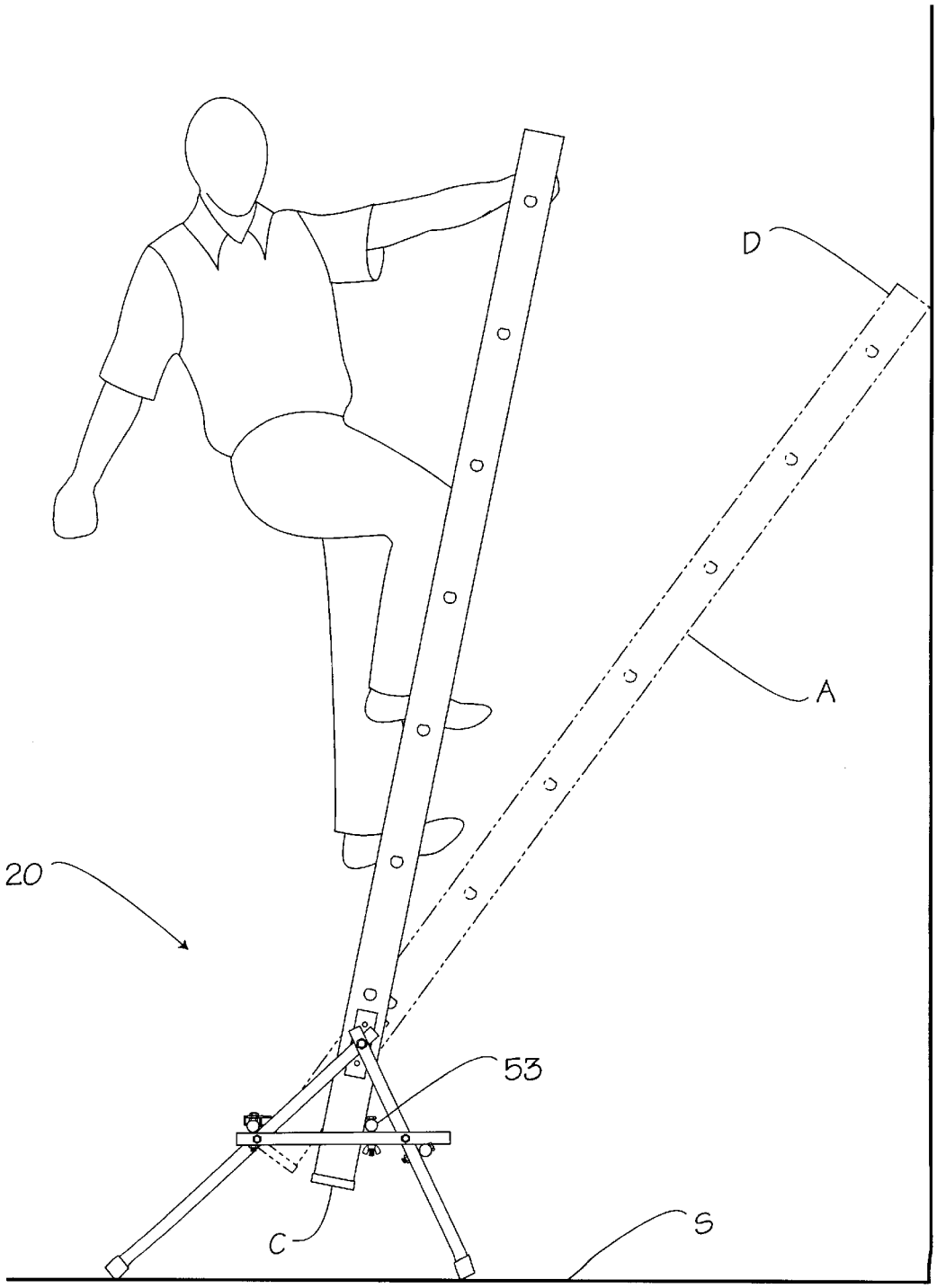
FIG. 8 is a side elevation view of the apparatus and ladder of FIG. 5, on a reduced scale, showing the ladder inclined alternatively at shallow and steep angles with respect to a supporting surface.

Conversely, as shown in solid lines in FIG. 8, safety support apparatus 20 allows ladder A to be pivoted rearward until the rear surface of the ladder rails abut anti-kickback bar 53. The present inventor has found that a ladder supported by safety support apparatus 20 according to the present invention may be tilted rearwards to a steep angle of about 85 degrees, without any tendency to tip over, in contrast to a maximum safe value of about 75 degrees for prior art ladders. In fact, the present inventor has found that the stability of a ladder pivotably supported by safety support apparatus 20 according to the present invention is great enough to permit the ladder to be used in a free-standing configuration, without requiring the upper end to be supported at all, even with a person standing on the ladder and leaning backwards, as shown in FIG. 8.

To achieve the aforementioned capability for safely supporting a ladder over a relatively large range of inclination angles, the present inventor has found that the front leg 22 of each A-frame 21 should be longer than rear leg 23, in the approximate ratio of 27" to 19½". With this ratio, the angle between straight front leg 22 and the horizontal surface, or base of the triangular shaped A-frame is about 38 degrees, the interior vertex angle between front leg 22 and rear leg 23 is about 80 degrees, and the rear interior angle between rear leg 24 and a horizontal base line joining the base of the rear leg to the base of the front leg is about 62 degrees. Although the angles are not extremely critical, the present inventor has found that substantial deviations from the above-listed nominal values reduce the stability of apparatus 20. Preferably, therefore, each of the angles should be within a tolerance of about ±2 degrees of the nominal values.

In an exemplary embodiment of the present invention, safety support apparatus 20 had the following approximate dimensions:

Width: Interior 17" to 19"

Width: Exterior 23" to 25"

Depth, measured between the bases of front and rear legs 22 and 23: 29"

Height of triangular A-frame 21: 18"

Height of axis of pivot bolt 24: 16½

In an example embodiment of safety support apparatus 20, each of the straight members was cut from aluminum tubing having an outer diameter of 1 inch and an inner diameter of ¾ inch.

Figure 9:
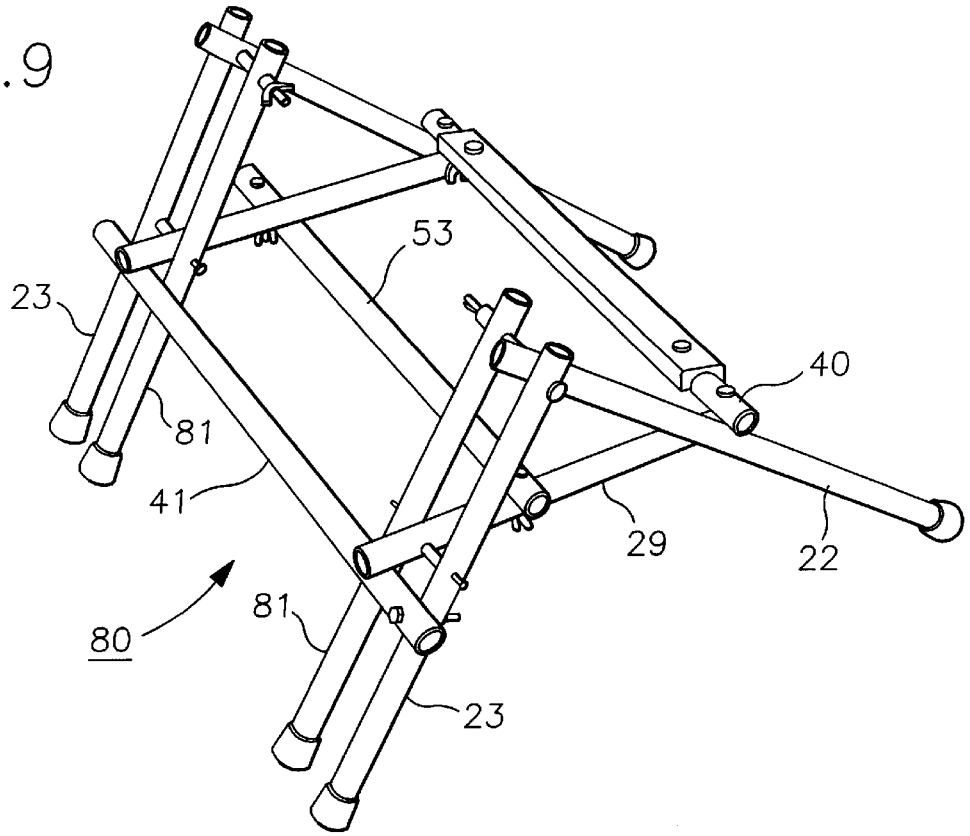
FIG. 9 is an upper left perspective view of a first modification of the apparatus of FIG. 1.

FIG. 9 is a perspective view of a first modification 80 of the safety support apparatus 20 shown in FIGS. 1–8 and described above. Modified safety support apparatus 80 is substantially identical to safety support apparatus 20, but includes a pair of auxiliary rear legs 81 in addition to rear legs 23 of the basic embodiment 20. Thus, as shown in FIG. 9, modified safety support apparatus 80 includes a pair of auxiliary rear legs 81, each of the same length as rear leg 23, oriented parallel to rear leg 23, and located laterally inwards of front leg 22 and longitudinal side member 29. Each auxiliary rear leg 81 is fastened at the upper end thereof to front leg 22 by pivot bolt 24, in the same manner as rear leg 23, and to side member 29, in the same manner as rear leg 23, using a longer bolt 37. Auxiliary rear legs 81 are provided to increase the stability of modified ladder support frame 80, by widening the stance of the apparatus.

Figure 10:
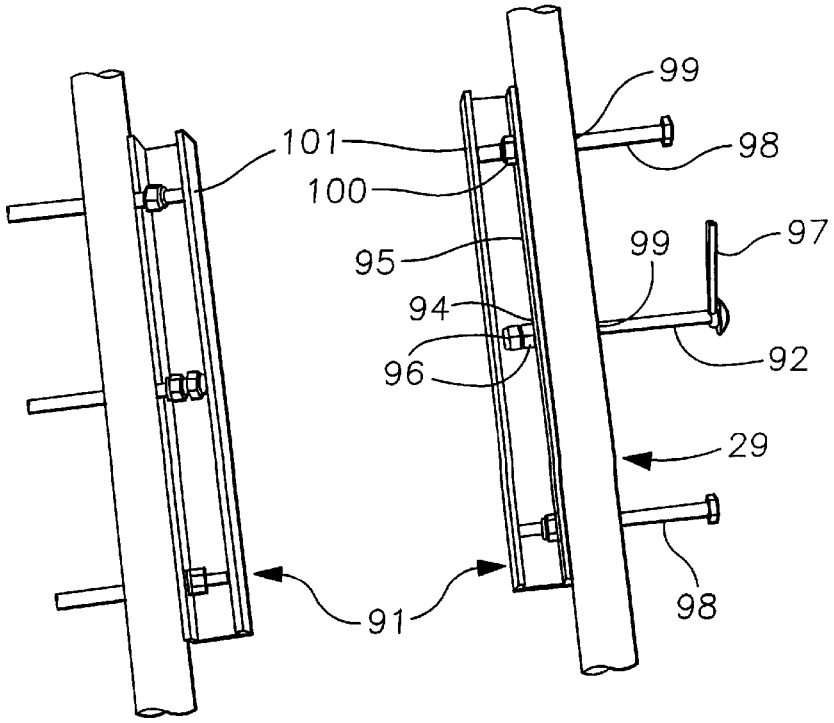
FIG. 10 is a lower plan view of modified side members of a second modification of the apparatus of FIG. 1.
Figure 11:
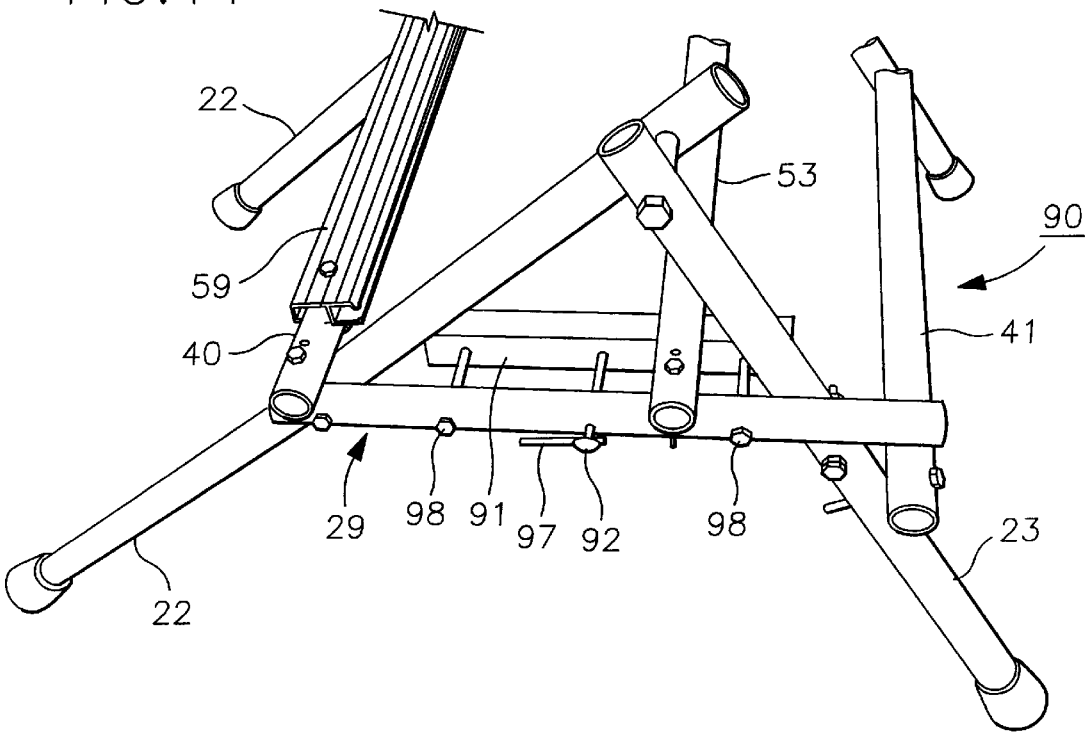
FIG. 11 is a right-side elevation view of a second modification of the apparatus of FIG. 1, showing support bars of the modified side members of FIG. 10 adjusted inwards of the side members.
Figure 12:
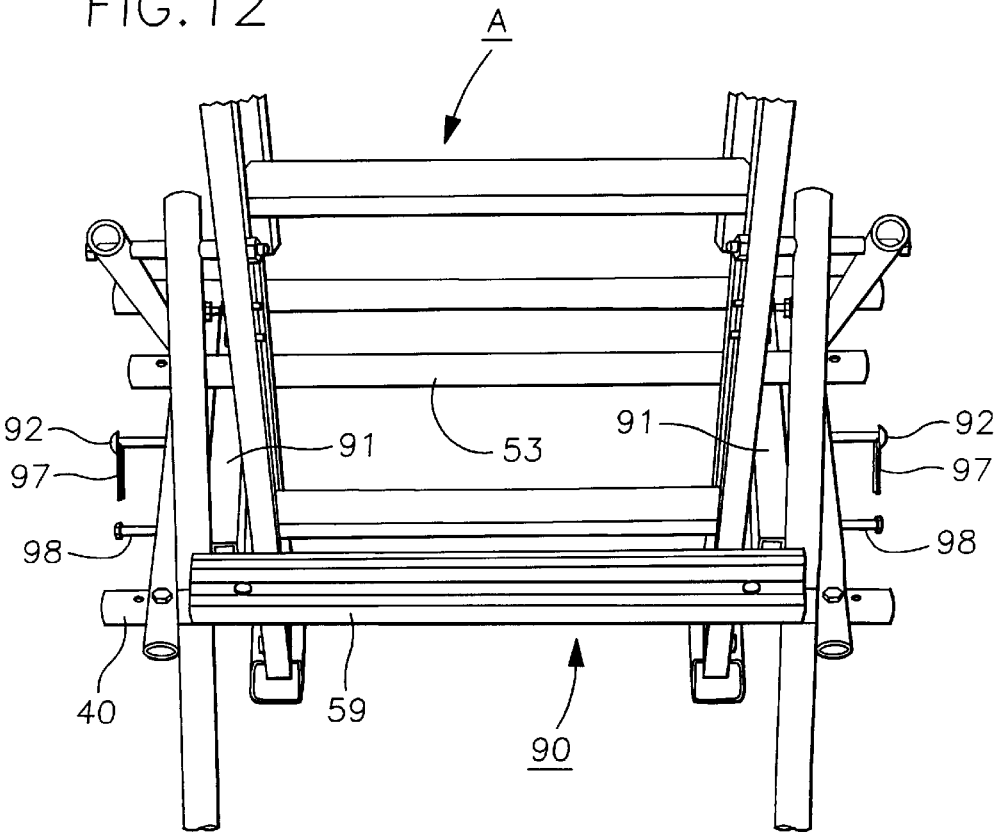
FIG. 12 is a front perspective view of the second modification of the apparatus of FIG. 1, showing a ladder attached to the apparatus.

FIGS. 10–12 illustrate a second modification 90 of the safety support apparatus 20 shown in FIGS. 1–9 and described above. As shown in FIG. 12, modified safety support frame 90 includes a pair of longitudinally disposed clamping members 91 positioned on either side of a ladder A to further secure the stability of the ladder within the support frame.

Referring now to FIG. 10, it may be seen that each clamping member 91 has the shape of a longitudinally elongated, inverted U-shaped channel, and is fastened to side member 29 in parallel disposition to the inner side wall thereof. As shown in FIG. 11, clamping member 91 is fastened to side member 29 at a laterally adjustable position by means of a transversely inwardly disposed threaded adjustment bolt 92 which is threadably received in a transversely disposed threaded hole through the side member. The inner end of adjustment bolt 92 is insertably received through a hole 94 provided through the thickness dimension of outer wall 95 of clamping member 91 and secured to the clamping bar by nuts 96. Preferably, a crank arm 97 is attached perpendicularly to the outer end of bolt 92 to facilitate tightening or loosening the bolt to advance or retract the clamping member 91 relative to side member 29.

As shown in FIG. 10, clamping member 91 is maintained parallel to side member 29 using a pair of guide bolts 98 located on opposite longitudinal sides of adjustment bolt 92. Guide bolts 98 are slidably received in through-holes 99, and attached at the inner ends thereof to clamping member 91 by nuts 100.

Referring now to FIGS. 11 and 12, it may be seen that clamping members 91 may be advanced laterally inwards by turning clamping bar adjustment bolts 92, thereby bringing the inner walls 101 of the clamping members into abutting contact with the outer wall surfaces of ladder rails B, and thus further securing ladder A within modified safety support apparatus 90.

As shown in FIG. 1, front and rear A-frame legs 22 and 23 function as support legs for apparatus 20. Thus, the lower ends of each of those legs, which contact a floor, ground, or other supporting surface, preferably are fitted with rubber caps 82, to protect the lower ends of the legs from being dented and to minimize any tendency for the legs to slip on a supporting surface.

Figure 13:
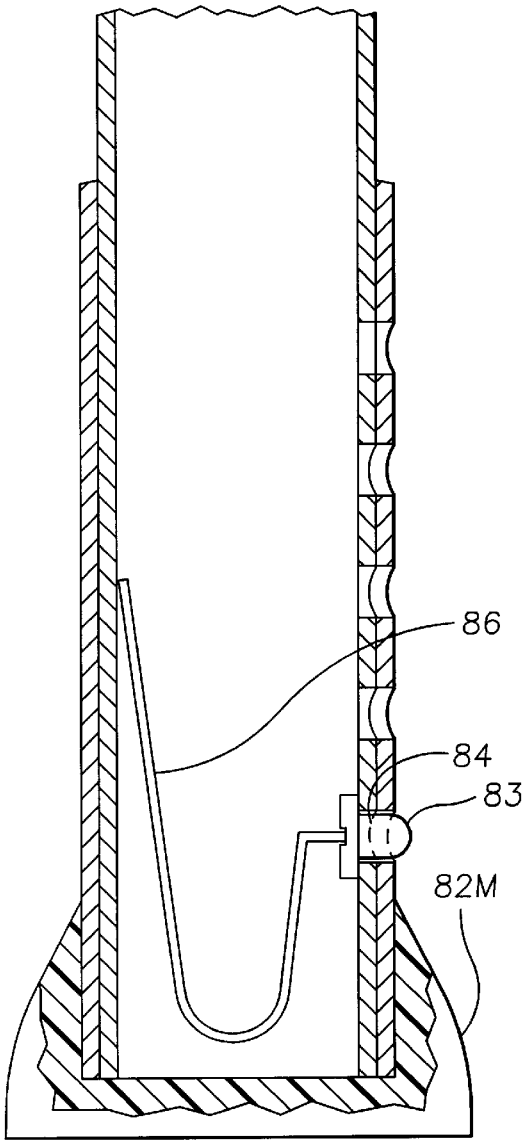
FIG. 13 is a front elevation view of a modification of support legs of the apparatus of FIG. 1.
Figure 14:
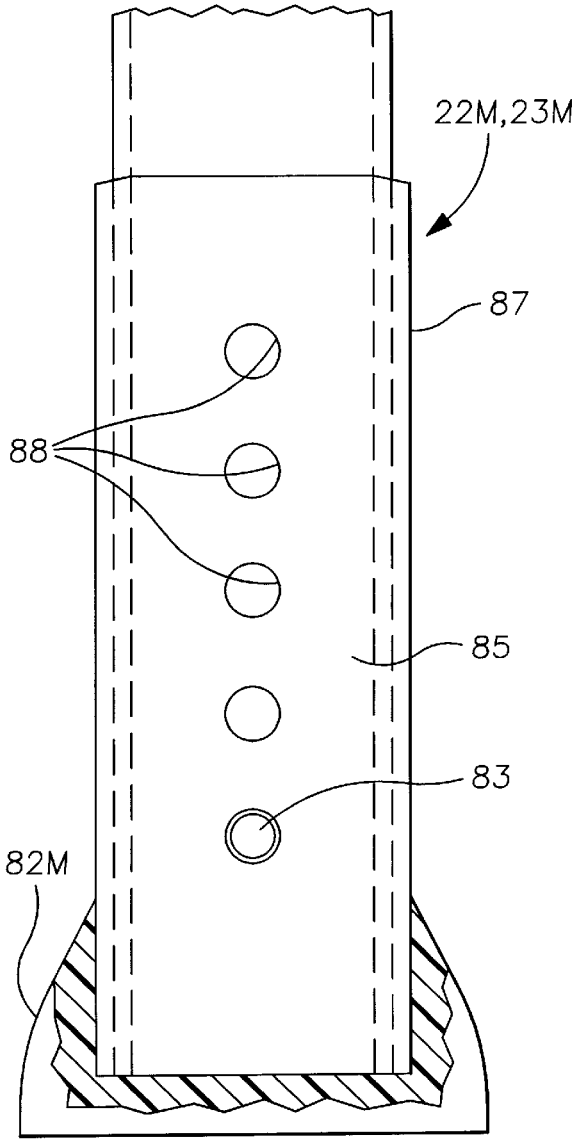
FIG. 14 is a side sectional view of the structure of FIG. 13.

FIGS. 13 and 14 illustrate a modification of front and rear A-frame legs 22 and 23 of the apparatus shown in FIG. 1. In this modification, the length of each of the legs may be individually adjusted to adapt to irregular, non-level supporting surfaces, thereby maintaining the ladder at a desired inclination angle, with the rungs horizontally disposed, in spite of the irregularity of the supporting surface.

As shown in FIGS. 13 and 14, the lower end of modified tubular A-frame leg 22M is provided with a transversely disposed, flanged detent button 83 which is urged radially outwards through a bore 84 provided through front side wall 85 of the leg, by a spring 86. A tubular leg extension 87 fits coaxially over leg 22M, and is provided with a plurality of longitudinally spaced apart detent holes 88, adapted to receive detent button 83. With this arrangement, tubular leg extension 87 may be slipped coaxially over leg 22M, and slid to a desired longitudinal location, where detent button 83 protrudes through a selected detent hole 88, thus allowing adjustment of the height of apparatus 20. Preferably, the lower end of tubular leg extension 87 is fitted with a non-slip rubber cap 82M.

In a variation of modified A-frame support legs 22M and 23M, bores 84 and 82 may extend completely through legs 22M and leg extension 87, respectively. In this variation, detent button 83 and spring 86 may be replaced by a straight cylindrical pin or cotter pin inserted through the bores.

What is claimed is:

1. A safety support apparatus for ladders comprising;

a. a pair of laterally spaced apart, parallel A-frames, each of said A-frames having a first straight, elongated front leg that angles upwardly and rearwardly from a lower end thereof, a second straight, elongated rear leg joined near an upper end thereof to an upper portion of said front leg, by a laterally inwardly disposed bolt received in a pair of bores provided through said front and rear legs, said rear leg angled downwardly and rearwardly, said rear leg having a lower end which defines with said lower end of said front leg a longitudinal base line, each of said A-frames having a longitudinal side member fastened at opposite ends thereof to intermediate portions of said front and rear legs, b. laterally disposed strut means for holding said A-frames in a laterally spaced apart parallel vertically disposed position said strut means comprising in combination front and rear transversely disposed strut members, each fastened at opposite lateral ends thereof to said A-frames, said bases of said A-frames defining a horizontally disposed base plane, c. pivot means comprising inwardly protruding shanks of said bolts, each of said shanks protruding inwards of said A-frame and adapted to penetrate a pivot bore provided through a side rail of a ladder, d. means for fastening each of said bolts to said side rail of said ladder comprising a threaded fastener tightened down on said shank and adapted to bear against an inner wall surface of said ladder side rail, and e. a bearing bushing fitting coaxially over that portion of said bolt shank located inward of the adapted to abut an outer side of said lateral inner side of A-frame and said ladder side rail, said front and rear legs of each of said A-frames being fastened at opposite lateral sides thereof to said longitudinal side member, thereby spacing the upper ends of said front and rear legs laterally apart from one another.

2. The apparatus of claim 1 wherein said means for fastening said upper ends of said front and rear legs of each A-frame is further defined as being a laterally inwardly disposed bolt received in a pair of bores provided through said front and rear legs.

3. The apparatus of claim 2 wherein said pivot members are further defined as being inwardly protruding shanks of said bolts, each of said shanks protruding inwards of said A-frame and penetrating a pivot bore provided through said rail of said ladder.

4. The apparatus of claim 3 wherein said means for fastening said pivot member to said rail is further defined as comprising in combination a threaded end portion of said bolt shank, and a threaded fastener tightened down on said shank to bear against the inner wall surface of said ladder side rail.

5. The apparatus of claim 4 further including a bearing bushing fitting coaxially over that portion of said bolt shank located between the lateral inner side of said A-frame and said ladder side rail.

6. The apparatus of claim 5 wherein said front and rear legs of each of said A-frames are further defined as being fastened at opposite lateral sides thereof to said longitudinal side member, thereby spacing the upper ends of said front and rear legs laterally apart from one another.

7. The apparatus of claim 1 further including a spacer bushing fitting coaxially over that portion of said fastening bolt shank spanning the space between the upper ends of said front and rear legs.

8. The apparatus of claim 1 wherein said longitudinal side member is located laterally between said front and rear A-frame legs.

9. The apparatus of claim 1 further including a laterally disposed anti-kickback member fastened at opposite ends thereof to laterally aligned intermediate portions of said longitudinally disposed side members of said A-frames, whereby the anti-kickback member is adapted to contact said ladder side rail thereby limiting rearward pivotal motion of an upper portion of said ladder.

* * * * *